US008584839B2

(12) United States Patent
Aguadisch et al.

(10) Patent No.: US 8,584,839 B2
(45) Date of Patent: Nov. 19, 2013

(54) DEVICE FOR PRESERVING AND RELEASING A PRODUCT CONTAINED IN A RESERVOIR HAVING A RUPTURABLE WALL

(75) Inventors: Louis Aguadisch, Valbonne (FR); Gilles Stalet, Grasse (FR); Patrick Sivera, Saint Sauveur (FR)

(73) Assignee: STE de Thermoformage et d'Injection des Plastics, Beauvoir en Royans (FR)

( * ) Notice: Subject to any disclaimer, the term of this patent is extended or adjusted under 35 U.S.C. 154(b) by 187 days.

(21) Appl. No.: 13/128,872

(22) PCT Filed: Nov. 12, 2009

(86) PCT No.: PCT/EP2009/065053
§ 371 (c)(1),
(2), (4) Date: Jul. 28, 2011

(87) PCT Pub. No.: WO2010/055092
PCT Pub. Date: May 20, 2010

(65) Prior Publication Data

US 2011/0278185 A1 Nov. 17, 2011

(30) Foreign Application Priority Data

Nov. 12, 2008 (FR) ..... 08 57662

(51) Int. Cl.
*B65D 25/08* (2006.01)
*B65D 51/28* (2006.01)

(52) U.S. Cl.
USPC ..... 206/219

(58) Field of Classification Search
USPC ..... 206/219, 222; 215/DIG. 8, 227, 228
See application file for complete search history.

(56) References Cited

U.S. PATENT DOCUMENTS

| | | | | |
|---|---|---|---|---|
| 8,376,988 | B2 * | 2/2013 | Perovitch | 604/88 |
| 2009/0236303 | A1 * | 9/2009 | Lizerbram et al. | 215/227 |
| 2011/0259769 | A1 * | 10/2011 | Salinas | 206/219 |
| 2012/0061421 | A1 * | 3/2012 | Roth et al. | 222/83 |
| 2012/0193249 | A1 * | 8/2012 | Lizerbram et al. | 206/222 |

FOREIGN PATENT DOCUMENTS

| | | |
|---|---|---|
| DE | 199 50 884 A1 | 4/2001 |
| FR | 2 895 378 | 6/2007 |

(Continued)

OTHER PUBLICATIONS

Annex 1 of Commission Regulation (EC) No. 1565/2000, Chemical Groups for Flavouring Substances, Jul. 19, 2000.

(Continued)

*Primary Examiner* — Jacob K Ackun
(74) *Attorney, Agent, or Firm* — Blakely Sokoloff Taylor & Zafman

(57) ABSTRACT

The present invention relates to a removable device for preserving and releasing a product contained in a reservoir (2) having a rupturable wall. Said device is in the form of a stopper (1) intended to be fitted on a container (5), and comprises:

a cap (3) which is able to engage with the neck (50) of the container (5) and through which passes a hollow dispensing tube (12) which leads into said container (5), and an insert (4) able to be positioned on or in the neck (50) of the container.

The cap (3) and the insert (4) delimit a rigid chamber (10) of variable volume, containing at least one reservoir (2) containing said product and at least one opening (11) for releasing the product in the container (5).

Means enable the cap (3) and the insert (4) to be moved closer together, reducing the volume of the chamber (10) and rupturing the reservoirs (2). These means consist of a screw thread (30) present on the cap (3) and engaging with the screw thread (51) on the neck (50).

14 Claims, 9 Drawing Sheets

(56) References Cited

FOREIGN PATENT DOCUMENTS

| | | |
|---|---|---|
| JP | 2002-539039 | 11/2002 |
| WO | WO9803265 (A1) | 1/1998 |
| WO | WO 00/53507 | 9/2000 |
| WO | WO 2004/024587 A | 3/2004 |

OTHER PUBLICATIONS

English translation of nte ational Preliminary Report on Patentability (Chapter 1), Jun. 7, 2011.

* cited by examiner

DEVICE FOR PRESERVING AND RELEASING A PRODUCT CONTAINED IN A RESERVOIR HAVING A RUPTURABLE WALL

This is a non-provisional application claiming the benefit of International application number PCT/EP2009/065053 filed Nov. 12, 2009.

FIELD OF THE INVENTION

The invention relates to a removable device for preserving and extemporaneously releasing a product contained in a reservoir having a rupturable wall, and notably for releasing said product and extemporaneously mixing same with a base product contained in a container, prior to the distribution of said mixture.

BACKGROUND OF THE INVENTION

Many products include additives, for example flavorings or fragrances intended to improve their organoleptic properties, or active agents used in cosmetics, pharmaceuticals, etc.

However, these additives can be altered over time due to reactions that occur once they are mixed with the base product.

This can be caused by an unstable mixture, an incompatibility of the additive product with the base product, etc.

This problem is particularly noticeable for cosmetic products, such as hair-coloring products, whose odor can cause discomfort to both the person that applies the product and the person to which the product is applied.

However, the compositions generally used in these types of coloring products include chemical active agents, such as ammonia, which generally quickly degrade fragrances and other olfactory compositions intended to mask the unpleasant odor of the base composition.

To preserve the properties of the additive, it is known to preserve the additive in a suitable reservoir, separately from the base product, and to proceed with extemporaneous mixture of the base product and the additive.

One such example that can be cited in this regard is patent application FR2895378, which proposes a sequential release of an aromatic or scented composition in a base product contained in a container.

The device described in this patent application caps the stopper of a container, wherein the aromatic composition is contained in capsules that can be ruptured under the mechanical or chemical action of the base product during its expulsion from the container.

However, such a device does not enable user control, and involves progressive release of the aromatic or scented composition as the base product is expelled.

It is thus not possible to carry out genuine and effective mixing between the aromatic composition and the base product before its use.

There is thus a risk of inhomogeneous distribution of the aromatic or scented composition, the consequence of which is the distribution of a product whose organoleptic characteristics are not guaranteed during the expulsion of the final contents of the bottle, for example.

In addition, said device is in the form of an adaptable end on a nozzle serving to distribute the base product out of the container. This very specific design thus involves cooperation between the device and the packaging of the base product and is not adaptable to any type of container available on the market.

Document WO 2004/024587 describes a "sports-cap" device for beverage containers. Formed of three superimposed mounted members creating a central axial channel enabling the distribution of the beverage for its consumption, this device also contains an encapsulated liquid colorant intended to be mixed extemporaneously with said beverage. Among said three members, the first member is adapted to be screwed on the neck of the container and is designed to receive at least one capsule containing the colorant. An opening in this first member enables the colorant to flow into the beverage to be colored, after rupture of the capsule. The second member, which slides axially on the first, crushes and ruptures the capsule under axial pressure exerted by the user's fingers on the upper rim of the second member. The third member corresponds to the nozzle of the sports cap. Able to move between two positions, it enables the system to be opened and closed.

A first disadvantage encountered with this device is the absence of a safety member preventing premature rupture of the capsules, for example in the event of the untimely bringing together of the first and second members during transport of said device.

This device also has the disadvantage of significant bulk. The use of a device of this design is hard to envisage in a field other than that of beverages, such as for example in cosmetics and pharmaceuticals where containers are generally much smaller and the neck narrower. As this is a sports-cap specifically intended for beverage containers, those persons skilled in the art are rather disinclined to use and/or adapt it for other containers.

Lastly, insofar as the rupturing of the capsules is dependent on the strength of the user, the quantity of the encapsulated product actually released can vary greatly from one user to the next and even from one use to the next. This defect in the repeatability/reproducibility of the amount released is totally unacceptable in terms of pharmaceutical or cosmetic products. Further, because of this dependence on the strength of the user, such a device has serious limits, in particular in the choice of the resistance to rupture of the capsules and the number of capsules to be integrated.

The invention aims at remediating said disadvantages.

In particular, one of the goals of the invention is to provide a device for the packaging and release of a product contained in a reservoir having a rupturable wall, which enables maintenance of the integrity of said reservoir notably during storage and transport of said device, and which by its simple design can be adapted to a large number of containers, including those of small size encountered in the pharmaceutical and cosmetics fields, for example.

The invention further aims at facilitating the rupture of the wall of said reservoir during the voluntary action of the user and to guarantee satisfactory reproducibility/repeatability in the release of the contents of the reservoir.

BRIEF DESCRIPTION OF THE INVENTION

To this end, and in accordance with the invention, a removable device is proposed for preserving and releasing a product contained in a reservoir having a rupturable wall for releasing said product, wherein said device comprises a rigid chamber of variable volume containing at least one reservoir with said product, wherein said chamber comprises at least one opening for releasing the product out of the device and comprising two components that can be moved with respect to each other, delimiting the chamber of variable volume in order to cause the rupturing of the rupturable wall by crushing when they are brought together.

More precisely, said device is advantageously in the form of a stopper intended to be fitted on a container and comprising:

a cap which is able to engage with a neck of said container and through which passes a hollow dispensing tube which leads into said container, wherein said cap comprises the first movable component, an insert able to be positioned on or in the neck of said container, wherein said insert comprises the second movable component, wherein said cap and said insert delimit said rigid chamber of variable volume, and can be moved with respect to each other in order to cause the rupturing of the rupturable wall by crushing when they are brought together, characterized in that said stopper comprises means to displace the cap with respect to the insert and with respect to the neck, consisting of a screw thread engaging with a screw thread interdependent with the neck.

The openings of the chamber are then situated on the part of the stopper intended to be placed inside the container, to enable the release of the product in the container.

Said device advantageously comprises means for holding the two movable components in a given "distant" position, wherein said means are able to yield when a suitable force is applied to the device to enable said elements to be brought together.

The insert can consist of a cylindrical peripheral wall extending from a bottom, wherein the upper end of the peripheral wall comprises a collar resting on the upper edge of the neck of the container and the bottom of the insert comprises the openings for the distribution of the product in the container.

According to a particular embodiment, the bottom of the insert forms, as such, said second movable component.

According to a particular embodiment, the cap has a bottom with an outer side which forms said first movable component.

Said stopper comprises means to displace the cap with respect to the insert and/or the neck of the container. Said means advantageously consist of a screw thread engaging with a screw thread interdependent with the neck.

According to a particular embodiment, said stopper advantageously comprises means to displace the cap with respect to the insert and with respect to the neck of the container. Said means consist of a screw thread engaging with a screw thread interdependent with the neck. In this particular embodiment, wherein the insert remains fixed with respect to the neck (by virtue of, for example, a collar resting on the upper edge of the neck of the container), the screwing of the cap on the neck leads to the displacement of the first movable component of the cap toward the second movable component of the insert, thus creating a progressive reduction of the volume of the variable chamber and a meticulous crushing of the reservoir/reservoirs and the complete release of its/their contents. In comparison with other possible modes of crushing, in particular crushing by percussion, the crushing by screwing in conformity with the invention requires a minimum of effort and attention from the user. Such an advantage makes possible the use of reservoirs with high resistance to rupture and thus, with better integrity and offering better preserving of the encapsulated products.

Preferably, said stopper comprises a hollow dispensing tube which passes through it and which leads into said container.

The opening or openings are proportioned to maintain the reservoir or reservoirs in the chamber before and after the rupture of the rupturable wall.

According to a preferred embodiment of the invention, the reservoir is a spherical capsule having a rupturable wall.

In this case, the openings are circular and of a diameter smaller than that of the capsules.

According to a particular variant, the device comprises the same number of openings as reservoirs.

The invention further relates to the use of the device described above to release a product contained in a reservoir having a rupturable wall in a base product selected from: a pharmaceutical composition, a drug, a cosmetic composition for the skin or hair, foodstuffs, processed foodstuffs, nutraceuticals or health foods, a personal, domestic or industrial hygiene product, a phytopharmaceutical product or an insecticide.

The invention further relates to packaging for preserving two products intended to be mixed extemporaneously before their distribution, wherein said packaging consists of a container comprising a first base product and a stopper comprising a second product to be released, wherein the stopper is defined as above and below with a rigid chamber of variable volume containing at least one reservoir with said product, wherein said chamber comprises at least one opening for releasing the product and comprises two components, which can be moved with respect to each other, delimiting the chamber of variable volume in order to cause the rupturing of the rupturable wall by crushing when they are brought together.

The invention finally relates to a method for distributing a mixture of products mixed extemporaneously before their distribution, wherein the method comprises the application on the stopper of the packaging according to the invention of a suitable force to enable the rupturing of the rupturable wall of the reservoir and the releasing of the product in the container comprising the base product, the mixing of the product released with the base product and then the distribution of the mixture obtained out of the container.

BRIEF DESCRIPTION OF THE DRAWINGS

Other advantages and characteristics will be more readily apparent from the following description, in reference to the attached figures.

DETAILED DESCRIPTION OF THE INVENTION

Figure 1:
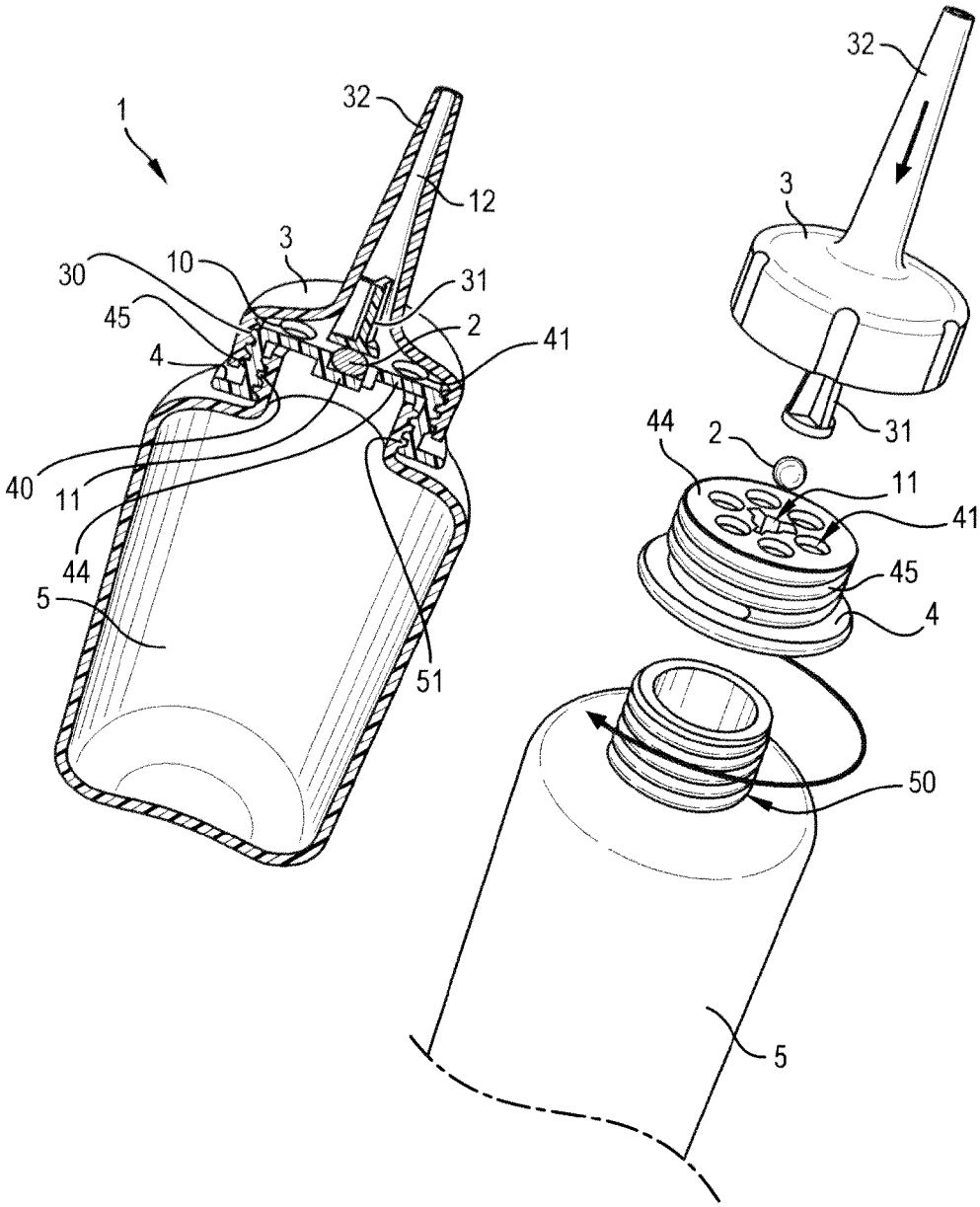
FIG. 1 represents a first embodiment of the invention.

According to the invention, "rigid" refers to a chamber whose mechanical properties make it possible to preserve the integrity of the reservoirs, so as to avoid the untimely rupture of the rupturable wall and the release of the product.

The rupture of the reservoir and the release of the product only occur when the movable components are brought together, an action which is controlled by the user.

The device according to the invention thus advantageously comprises means to hold the two movable components in a given "distant" or "resting" position, wherein said means are able to yield to enable the walls to be brought together when a suitable force is applied to the device. To avoid untimely rupture of the reservoirs, the force applied is determined not only in its intensity, by definition of a threshold to be exceeded, but also in its direction, as the result of a specific motion performed by the user of the device (for example rotation, grip, acceleration, axial pressure, etc.).

The suitable force must thus be sufficient to enable the movable components to be brought together, while being greater than a certain threshold guaranteeing that the reservoirs are not ruptured under the normal transport, handling and storage conditions, etc., of the device.

The means for holding the two components apart can comprise, for example, male and female forms arranged on the two movable components whose engagement prevents said movable components from being brought together.

"Movable components" refers to two components that move with respect to each other. According to certain embodiments, the action of bringing the components together can be carried out while one of the components remains fixed and the other moves.

According to the invention, "crushing" refers to any mechanical action that applies pressure to the reservoir so as to cause the rupturable wall to rupture, regardless of the form of the means by which this pressure is applied. In particular, this term covers punching (by means of a pointed component), pinching, percussion, etc.

According to the invention, "base product" refers to any carrier for an active agent that must be stored away from ambient air and/or from the carrier with which it will be mixed before its distribution.

Advantageously, the base product is in fluid form, notably a cream, milk, lotion, gel, ointment, pomade, emulsion, gas, solid dispersion or liquid dispersion.

The base product can be a pharmaceutical or cosmetic carrier. It can itself contain active substances or simply constitute a carrier for the active agent which will be released extemporaneously.

According to applications of the invention, the base product can be a pharmaceutical composition or a drug, or a cosmetic composition for the skin or hair, for example a shampoo, coloring or straightening product for the hair, or any other product intended to act on hair fiber, or a depilatory cream.

The base product can also be a foodstuff, processed foodstuff, nutraceutical or health food; or a hygiene product, in particular personal hygiene, notably oral hygiene, domestic hygiene or industrial hygiene, in particular a detergent, softener or bactericide; or, finally, the base product can be a phytopharmaceutical product or an insecticide.

The products to be released contained in the reservoirs are in particular selected from the active agents having an application in the pharmaceutical, cosmetics, phytosanitary and agri-food fields, etc. The preferred active substances are those which cannot be stably formulated in formulations or which are unstable for extended periods of storage.

In the fields of nutraceutical products and dietary supplements, the active agents to be released can be selected from the following non-exhaustive list: lutein, folic acid, fatty acids (DHA and ARA, for example), fruit and vegetable extracts, vitamins and mineral supplements, phosphatidylserine, lipoic acid, melatonin, glucosamine/chondroitin, Aloe vera, guggul, glutamine, amino acids (isoleucine, leucine, lysine, methionine, phenylalanine, threonine, tryptophan and valine, for example), green tea, lycopene, whole foods, additives, herbs, nutrients of plant origin, antioxidants, constituent flavonoids of fruits, linseeds, fish and marine animal oils, and prebiotics. They can also be dietary supplements and nutraceuticals containing foods resulting from biological and genetic engineering (or "functional foods").

In this respect, refer to the products cited in the work of Roberts et al., Nutraceuticals: The Complete Encyclopedia of Supplements, Herbs, Vitamins, and Healing Foods, American Nutraceutical Association, 2001.

The active agents to be released can also be raw materials of the fragrance industry (and mixtures thereof). They can be natural products such as essential oils, absolutes, resinoids or concretes, but also synthetic components of fragrances such as hydrocarbons, alcohols, aldehydes, ketones, ethers, acids, acetals and nitriles, including saturated and unsaturated compounds and aliphatic, sulfuric, amino, carboxylic, cyclic and heterocyclic compounds.

According to other applications of the invention, the products to be released can be active pharmaceutical and/or veterinary agents, selected, alone or in combination, from known therapeutic classes including, for example, proteins, peptides, nucleotides, agents for treating obesity, corticosteroids, elastase inhibitors, analgesics, antifungals, cancer therapies, analgesics, cardiovascular agents, anti-inflammatories, antiemetics, antiarrhythmic agents, antibiotics (including penicillin), anticoagulants, antidepressants, antidiabetic agents, antiepileptics, antihistamines, antihypertensive agents, antimuscarinics, antimycobacterials, antineoplastics, immunosuppressors, antivirals, sedatives, anxiolytics (hypnotics and neuroleptics), astringents, beta blockers, blood products and substitutes, cardiac inotropic agents, contrast agents, corticosteroids, antitussives (expectorants and mucolytics), diagnostic agents, diagnostic imaging agents, diuretics, dopaminergics, hemostatics, immunological agents, metabolic anomaly correctors, muscle relaxers, parasympathomimetics, calcitonin and bisphosphonates, parathyroid agents, prostaglandins, radiopharmaceutical products, sex hormones (including steroids), anti-allergic agents, thyroid regulators, vasodilators and xanthines.

According to other possible applications of the invention, the products to be released can be cosmetic ingredients and active agents.

Typical examples of active substances used in the field of cosmetic preparations are, for example, surfactants, cosmetic oils, waxes, stabilizers, preservatives, screens, agents that modify texture and rheology, anti-inflammatory active substances, plant extracts, yeast and algae extracts, vitamins, vitamin derivatives and complexes, amino acids and acids amino derivatives, bioactive lipids such as cholesterol, ceramides and pseudo ceramides, deodorants, antiperspirants, antidandruff agents, UV filters (minerals and organics), antioxidants, repellents, insecticides, skin pigmentation products, sunscreens, tyrosinase inhibitors (depigmentation agents), pigments and colorants.

According to other advantageous applications of the invention, the products to be released are food flavorings selected from, for example, the following list: hydrocarbons, alcohols, aldehydes, ketones, ethers, esters, acids, acetals, lactones, sulfur compounds and nitrogen compounds, which can be aliphatic or cyclic, linear or branched, saturated or unsaturated, carbocyclic or heterocyclic. More generally, refer to the products listed in Annex 1 of Commission Regulation (EC) No. 1565/2000 of Jul. 18, 2000.

According to the invention, "capsule" refers to a reservoir made up of a shell and a core, which comprises the product or products to be released.

Preferably, the thickness of the shell is between 30 μm and 500 μm, more preferably still between 100 μm and 200 μm.

The capsules have a hardness on the order of 1 kg to 20 kg, preferably from 1 kg to 10 kg, typically from 3 kg to 6 kg.

The capsules can be of various dimensions, according to the amount of active agent they contain. For example, in the case of spherical capsules, they generally have a diameter between 1 mm and 10 mm, preferably between 3 mm and 7 mm.

"Removable" refers to a device that can be used in combination with another component, such as a container, from which it can be separated without altering the properties of the device or its capacity to respond to the technical problem. The invention thus relates to the device alone or combined with another component such as a container in which the product will be released.

It is specified that in the various embodiments illustrated, the device comprises one or more spherical capsules, but it is understood that other forms of reservoirs can be used without being beyond the scope of the present invention.

In addition, a device in conformity with the invention can comprise several reservoirs containing different active agents, alone or in combination.

The form and the dimension of reservoirs within the same device can be identical or different, according to the amount of active agent to be released.

Similarly, the number of reservoirs contained in a device can vary according to the amount of product to be released.

The nature and the packaging of the product or products to be released are thus completely adjustable according to the base product and its destination.

In a particularly advantageous way, the device is marketed with a container on which it is fitted for the purpose of releasing the aromatic composition in the base product.

Such is notably the case for single-use packaging, that is to say, where the base product contained in the container is used only once.

The device is thus in the form of a removable stopper, that is to say, it can be delivered fitted on the container or separated from it. In the latter case, the user fits the stopper on the container at the moment of use.

It is specified that the stopper can be fitted on the container by any suitable means, such as by screwing, clipping, interlocking, etc.

The stopper can thus be adapted to any existing container.

Moreover, the device can comprise a safety system for preventing a child from releasing the active agent. Thus, when the device is an adaptable stopper on a container, the active agent can be released, for example, only by a combined push-turn movement.

Advantageously, the stopper further comprises a hollow dispensing tube passing through it which leads into the container. Thus, once the base product and the released active agent are mixed, the user can distribute this mixture by means of the hollow dispensing tube, without having to unscrew the stopper.

Preferably, the hollow dispensing tube is sealed during the delivery of the device, for example by means of a protective cap that can be broken off by the user when the user wishes to distribute the mixture. Of course, any other means of capping the hollow dispensing tube can be used.

The rupturable wall of the reservoir is normally designed not to disintegrate during its rupture.

The device can, however, comprise a filter to prevent the possible expulsion of debris from the rupturable wall of the reservoir at the moment the active agent is released. Thus, the openings and/or the hollow dispensing tube, as the case may be, can be equipped with filters or screens which those persons skilled in the art will be able to proportion in such a way as to prevent the possible passage of debris in the base product and/or during the expulsion of the mixture.

In the embodiments described below, the device is in the form of an adaptable removable stopper with a container containing a base product to scent or flavor, and through which passes a hollow dispensing tube for the distribution of the mixture. However, it is understood that the device can have other forms without being beyond the scope of the invention.

In the various figures described below, the same reference numbers are used to indicate components that are identical or that fulfill a similar function.

According to a first embodiment, illustrated in FIG. 1, the rupturable wall is ruptured by the crushing of the capsule when the two movable components of the stopper are brought together in an axial direction.

The device is in the form of a stopper 1 which is able to engage with the neck 50 of a container 5.

The stopper 1 comprises a cap 3, an insert 4 and an insert 31, acting as the first movable component in the context of the invention.

The cap 3 has a more or less cylindrical peripheral wall, with on its inner side a screw thread 30, and an end 32 through which passes a hollow dispensing tube 12.

The insert 4 has the general shape of an upside down U comprising a more or less cylindrical peripheral wall 42 with, on its inner side, a screw thread 40 corresponding to the screw thread 51 of the neck 50, and on its outer side, a screw thread 45 adapted to the screw thread 30 of the cap.

The stopper 1 thus caps the neck 50 and the stopper and the neck are engaged by the screw threads 40 and 51.

The bottom 44 of the insert has an opening 11 for releasing the product contained in the capsule, as well as one or more openings 41 for distributing the mixture.

In this embodiment, the stopper 1 advantageously comprises a single spherical capsule 2 and the insert 4 comprises a central opening 11 with a trilobed shape, of dimensions suitable for holding the capsule 2. The bottom of the insert 4, with its central opening 11, also acts as the second movable component in the context of the invention.

Furthermore, an insert 31 is inserted in the hollow dispensing tube 12 of the cap 3.

Before use, the stopper 1 is assembled by screwing the cap 3 on the insert 4 in such a way as to maintain a gap between the capsule 2 and the insert 31.

When the stopper 1 is screwed on the neck 50 of the container 5, the insert 31 is carried along in translation by the cap 3 in the direction of the insert 4.

The wall of the capsule 2 is ruptured by crushing between the insert 31 and the insert 4.

The product contained in the capsule is then released in the container 5 through the opening 11.

The user then proceeds to the mixing of the aromatic composition and the base product, and then to the opening of the end of the hollow dispensing tube 12 (by breaking off a protective cap, not represented here, located at the tip of the end 32, for example).

During the distribution of the mixture, it passes through the openings 41 situated on the periphery of the insert 4 and flows out of the hollow dispensing tube 12 of the stopper through the space provided between the insert 31 and the inner wall of the cap.

This layout creates turbulence in the mixture which helps improve its homogeneity.

Figure 2:
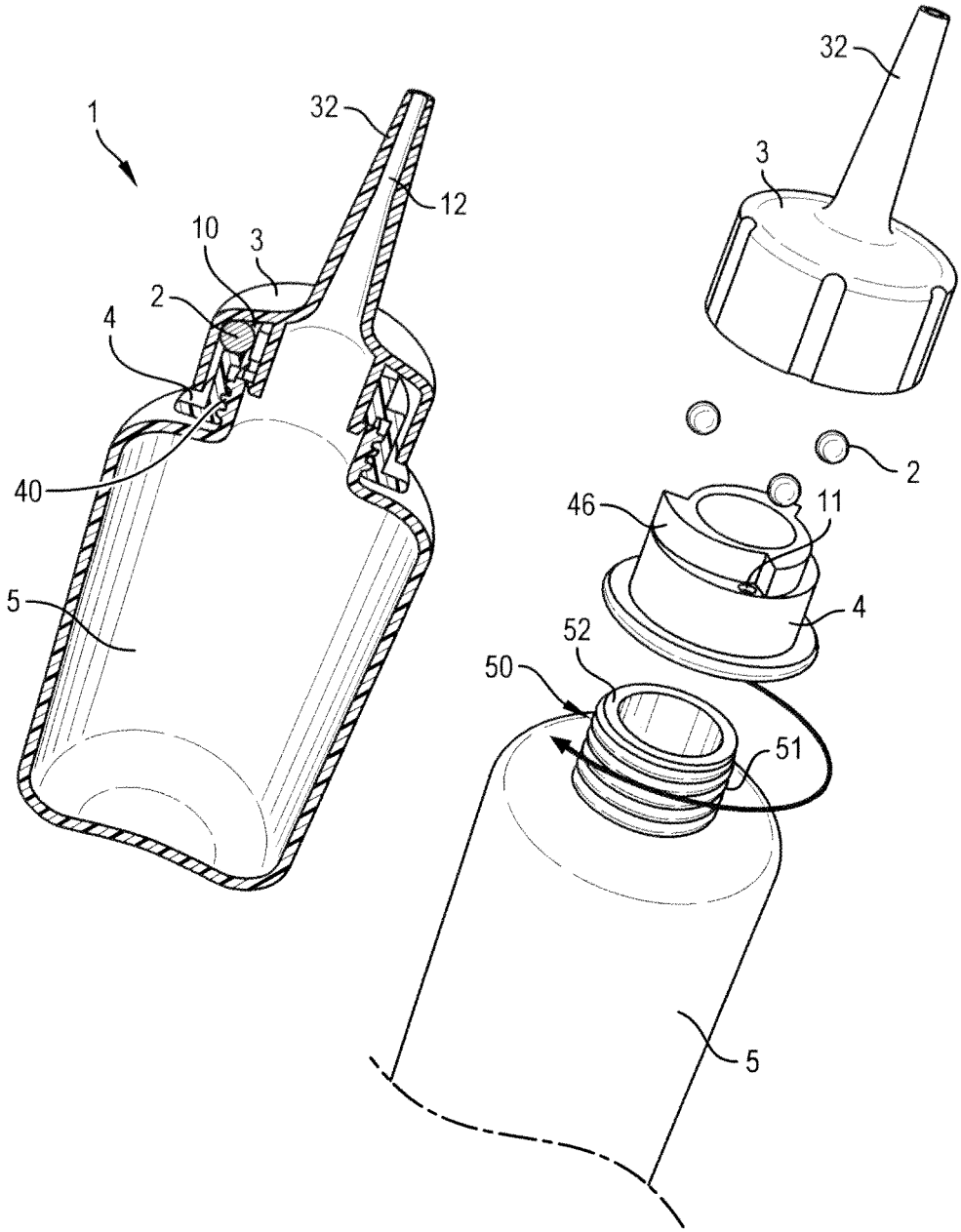
FIG. 2 illustrates a second embodiment of the invention.

According to a second embodiment, illustrated in FIG. 2, the stopper 1 comprises a cap 3 and an insert 4.

The insert 4 has a screw thread 40 adapted to the screw thread 51 of the neck 50 of a container.

The insert 4 has fins 46 between which the capsules 2 are situated (three in this case).

The insert 4 is arranged in the cap 3 in such a way as to constitute, between each fin 46 and the inner wall of the cap, a chamber 10 for each capsule.

Thus, when the stopper 1 is screwed on the neck 50, the volume of the chambers 10 decreases and the capsules are compressed between the fin 46 and the wall of the cap.

The product contained in the capsules is then released in the container through the openings 11.

Once the mixture is prepared, it is distributed by the central hollow dispensing tube 12 passing through the cap.

Figure 3:
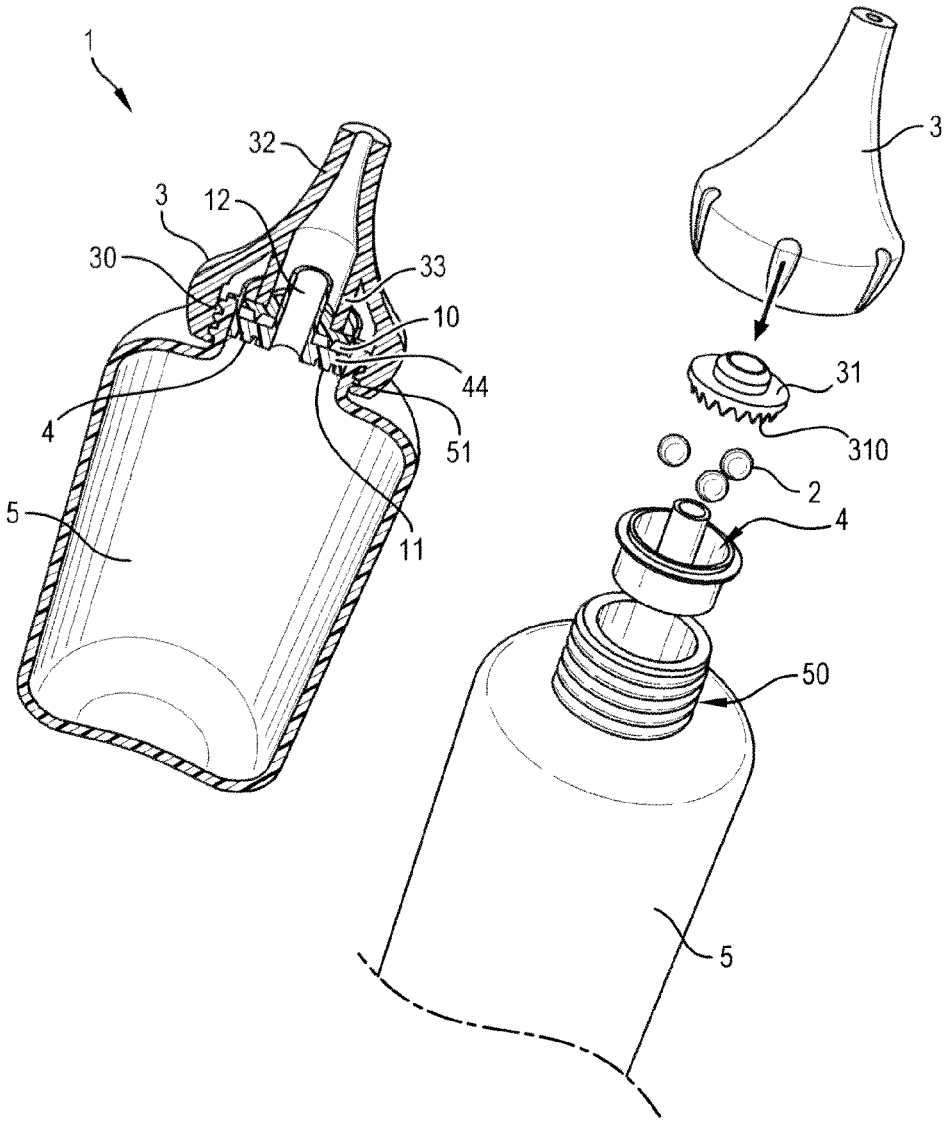
FIG. 3 illustrates a third embodiment of the invention.

According to a third embodiment, illustrated in FIG. 3, the rupturable wall is ruptured by punching.

In this embodiment, the stopper 1 comprises a cap 3 and an insert 4 containing one or more capsules 2, and an insert 31 acting as the first movable component in the context of the invention and having a toothed ring.

The cap 3 has a screw thread 30 corresponding to the screw thread 51 on the neck of the container.

The insert 4 has a perforated bottom 44 with openings 11 of a smaller diameter than that of the capsules. The upper surface of this perforated bottom 44 acts as the second movable component in the context of the invention.

Furthermore, the cap has a cylindrical inner wall 33 of a smaller diameter than that of the insert 31.

When the stopper 1 is screwed on the neck of the container, the insert 31 is carried along by the wall 33 in translation in the direction of the insert 4.

When the teeth 310 of the insert 31 come in contact with the capsules 2, they perforate them.

The aromatic composition is then released in the container 5 through the openings 11.

The insert 4 has a central hollow dispensing tube 12 enabling the passage of the mixture in view of its distribution through the end 32 of the cap.

Figure 4:
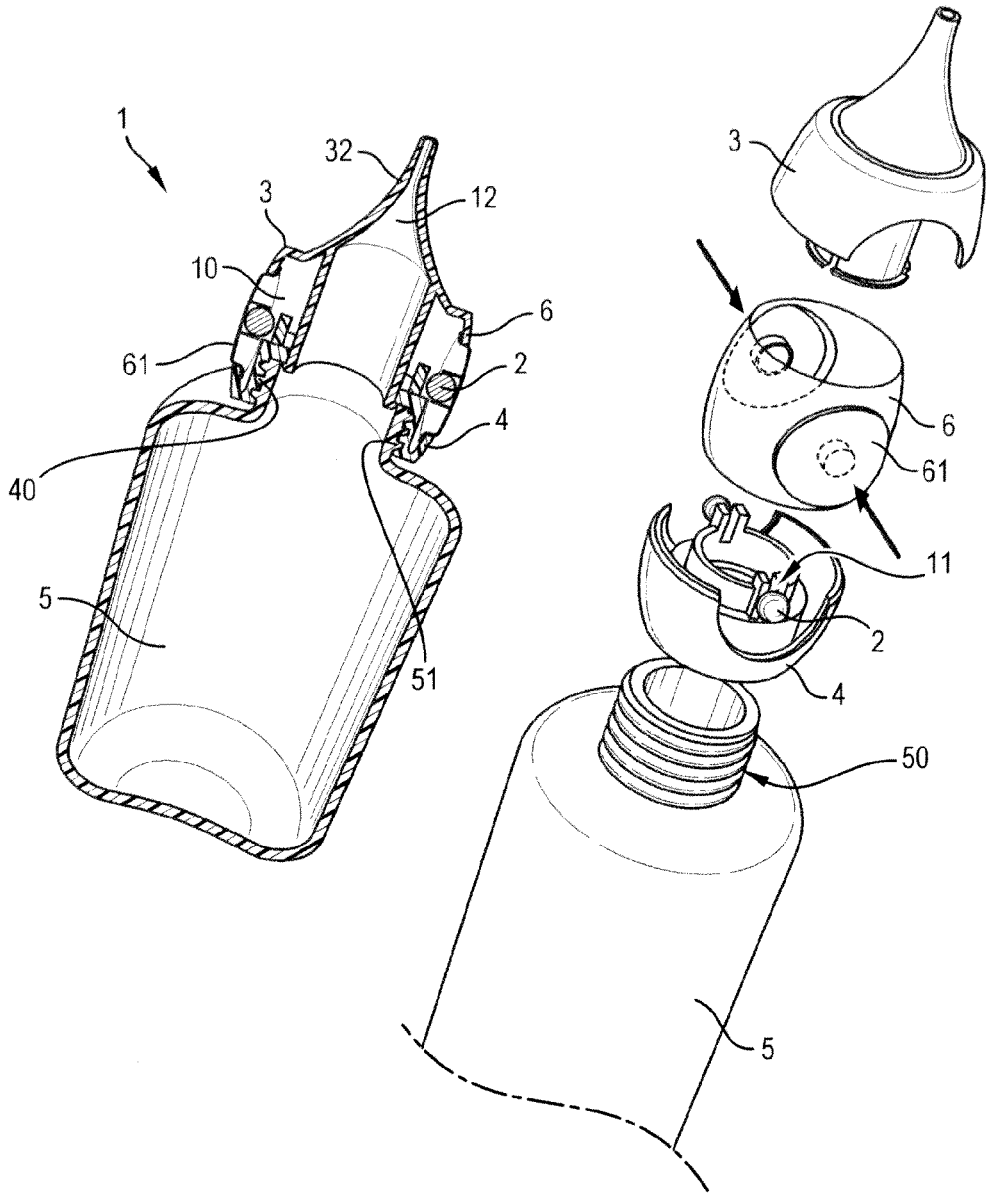
FIG. 4 illustrates a fourth embodiment of the invention.

According to a fourth embodiment, illustrated in FIG. 4, the rupturable wall of the capsule is ruptured by pinching.

The stopper 1 comprises a deformable insert 6 maintained between a cap 3 and an insert 4.

The cap 3 has an end 32 through which passes a hollow dispensing tube 12 for the distribution of the mixture.

The insert 4 has a screw thread 40 adapted to the screw thread 51 of the neck 50 of a container 5.

The capsule 2 is confined between a rigid wall of the insert 4 and a deformable zone of the wall of the insert 6. Said rigid wall of the insert 4 and said deformable zone of the wall of the insert 6 form the first and second movable components in the context of the invention.

The deformable insert 6 has a generally cylindrical shape. It is, for example, manufactured in an elastomer material, such as SEBS, for example.

On its wall are arranged two diametrically opposed zones 61 (for example, a thinner section of the wall or the use of a less rigid material).

The insert 4 is equipped with two more or less coaxial cylindrical walls.

The outer cylindrical wall of the insert 4 and the cap 3 is indented to make the flexible zones 61 accessible by the fingers of the user.

The inner cylindrical wall has two diametrically opposed openings 11 located opposite the indentations. The openings 11 have a width smaller than the diameter of the capsules.

After the capsules are inserted in their housings, the cap 3 and the insert 4 are rigidly bound, for example by welds, clips or any other suitable means to maintain the deformable insert 6.

Because it is maintained between the cap 3 and the insert 4, which are rigid parts, and because the deformable zones 61 are accessible by indentations in the cap 3 and the insert 4, the deformable insert 6 forms a rigid chamber 10 in the context of the invention. Indeed, this design of the device protects the deformable zones and limits the risks of untimely deformation leading to the rupture of the capsules.

The wall of the capsules is ruptured by the pinching action exerted by the user on the deformable zones 61, and the aromatic composition is released in the container via the openings 11.

By its ergonomics (pinching between the thumb and the index finger), this device is particularly suitable for the use of an even number of diametrically opposed capsules, but it is understood that the use of a single capsule, for example, can also be envisaged.

Furthermore, this device cannot be symmetrical and comprise an odd number of capsules.

It can further comprise several capsules containing different active agents, opposite as many deformable zones 61 and openings 11, wherein the choice of the active agent to be released is left to the user.

Figure 5:
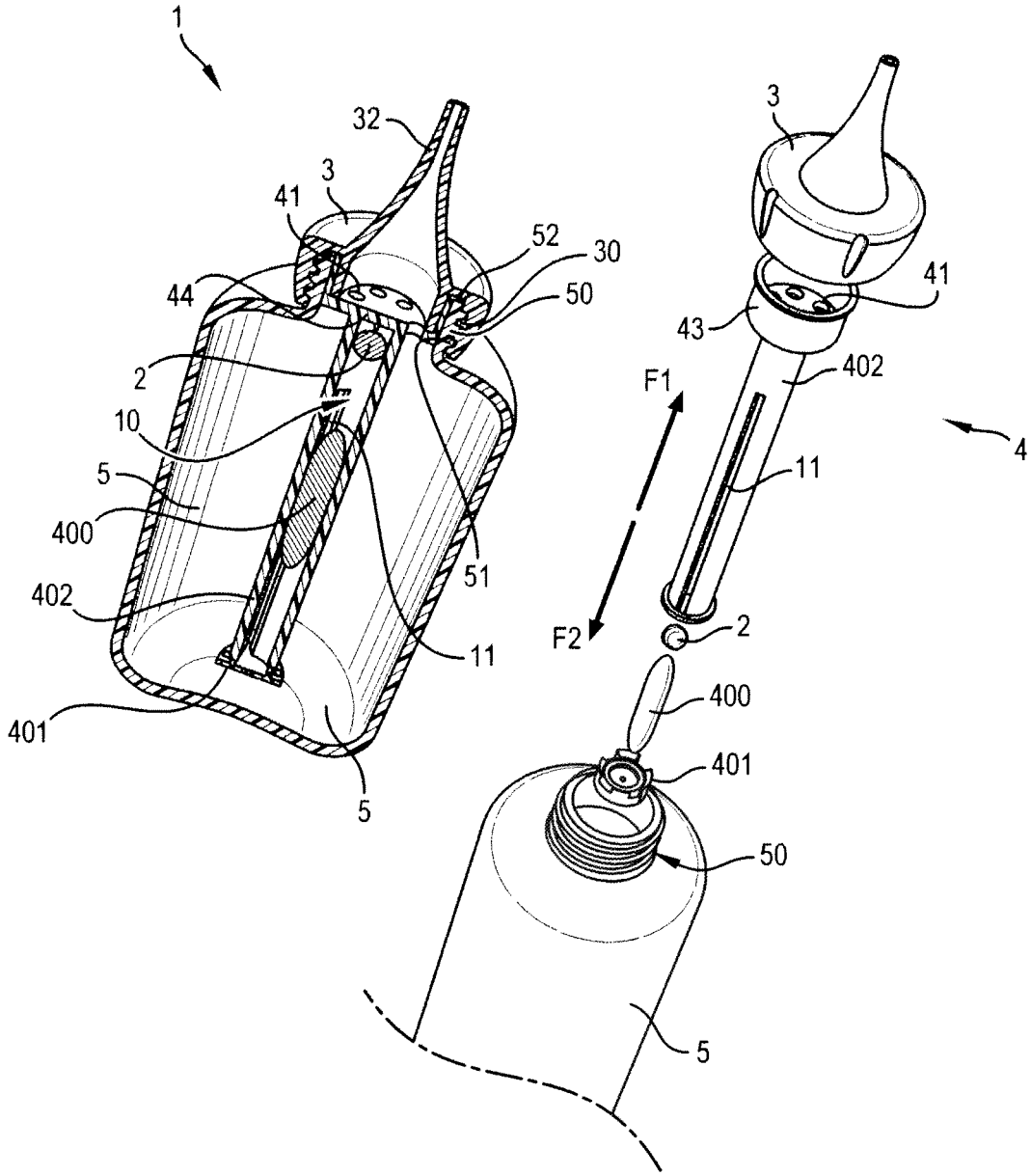
FIG. 5 illustrates a fifth embodiment of the invention.

According to a fifth embodiment, illustrated in FIG. 5, the rupturable wall of the capsule is ruptured by the impact of an inertial mass having undergone sufficient acceleration.

To this end, the capsule 2 and an inertial mass 400 are inserted in a more or less cylindrical housing 402 of an insert 4 interdependent with the cap 3.

The housing 402 has a length shorter than the depth of the container 5, so as to be able to be introduced into the container in view of the use of the packaging.

The cylindrical housing 402 is closed at both ends.

The housing 402 is, on the other hand, equipped with an opening for the release in the container 5 of the aromatic composition of the capsule. This opening is, for example, a longitudinal slot 11 in its lateral wall. One of the dimensions of the opening (in this case the width of the slot) is smaller than the diameter of the capsule.

Thus, the capsule is confined in the volume 10 between one of the ends of the housing 402 and the inertial mass 400.

The inertial mass 400 has, for example, a generally cylindrical shape of a diameter slightly smaller than the inner diameter of the housing 402, so as to be able to slide inside the housing.

The end of the inertial mass 400 closest to the capsule 2 is ovoid.

Furthermore, the inertial mass 400 is sufficiently heavy to be able to rupture the rupturable wall of the capsule 2 when the user shakes the packaging.

The insert 4 is assembled on the cap 3 so as to constitute an adaptable stopper 1 on the container 5.

To this end, the insert 4 comprises a bottom 44 perpendicular to the housing 402 and a peripheral wall 41 extended by a collar 43 intended to rest against the upper edge 52 of the neck of the container.

The insert 4 can be produced in a single piece by molding of a plastic material, with the end of the cylindrical housing 402 opposite the bottom 44 being left open to allow insertion of the capsule and the inertial mass. This opening is then sealed by means of a cap 401.

The cap 401 and the inertial mass 400 form the first and second movable components in the context of the invention.

The insert 4 and the cap 3 are joined in such a way that they cannot be dismantled, for example by glue, welds, clips, etc.

The cap 3 has a more or less cylindrical peripheral wall surrounding the neck 50 of the container and extended by an end 32 for the distribution of the mixture, said end being in the form of a nozzle sealed by a protective cap (not represented), for example.

On the inner side of its peripheral wall, the cap has a screw thread 30 corresponding to the screw thread 51 on the neck.

To use the packaging, the user screws the stopper 1 on the neck 50 of the container, and then shakes the packaging according to the axis along which the inertial mass 400 slides that is to say, in the direction of arrows F1 and F2), so that the inertial mass 400 strikes the capsule 2 several times until its wall is ruptured.

The product contained in the capsule is then released in the base product through the slot 11 and mixes with the base product under the effect of the shaking of the packaging.

After having ruptured the protective cap of the dispensing tube, the user can distribute the mixture thus obtained through the openings 41 provided in the bottom 44 of the insert 4.

This device has the advantage of optimizing the mixture since the release of the aromatic composition in the base product involves a mixing action on the part of the user.

Other advantages and characteristics will arise from the following description of the variant of execution, given as a nonrestrictive example of the distribution device according to the invention, by reference to FIGS. 6 to 9.

Figure 6:
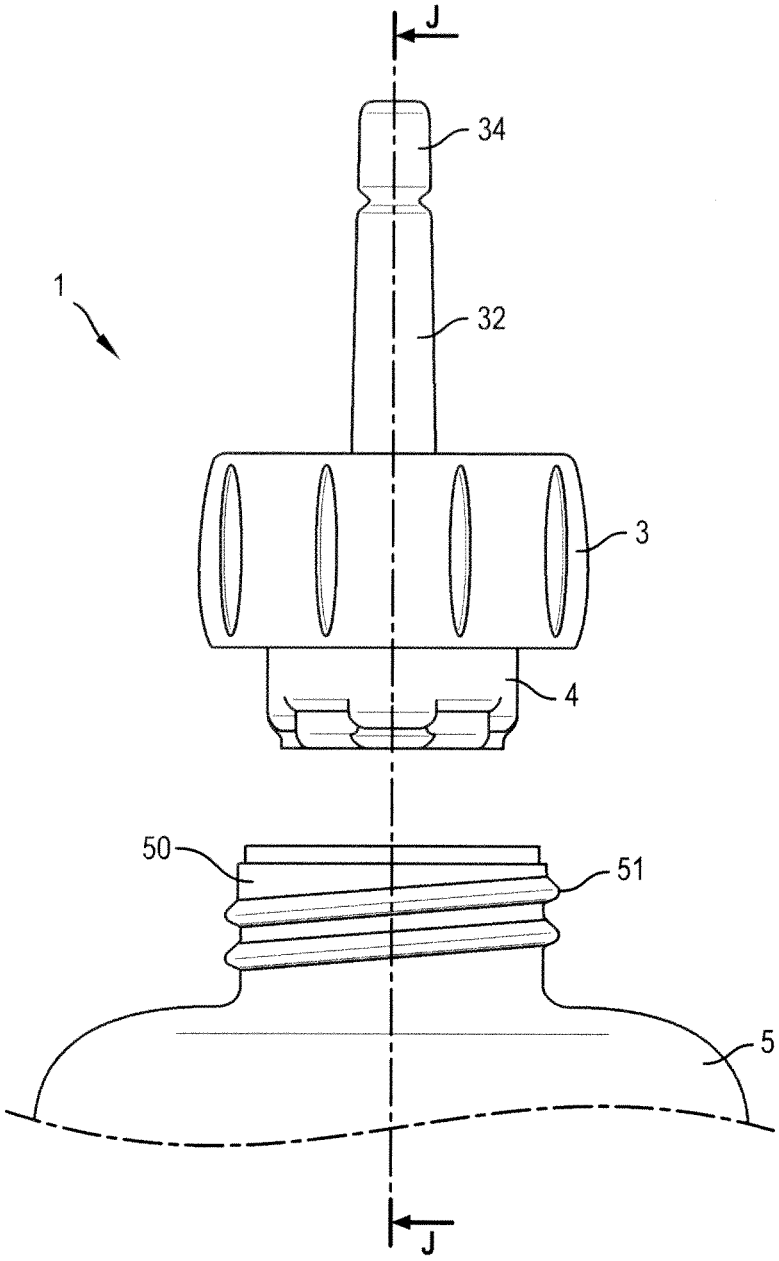
FIGS. 6 to 9 present the details of a particular variant of the invention.

FIG. 6 is a side view of the packaging as delivered before its use.

Figure 7:
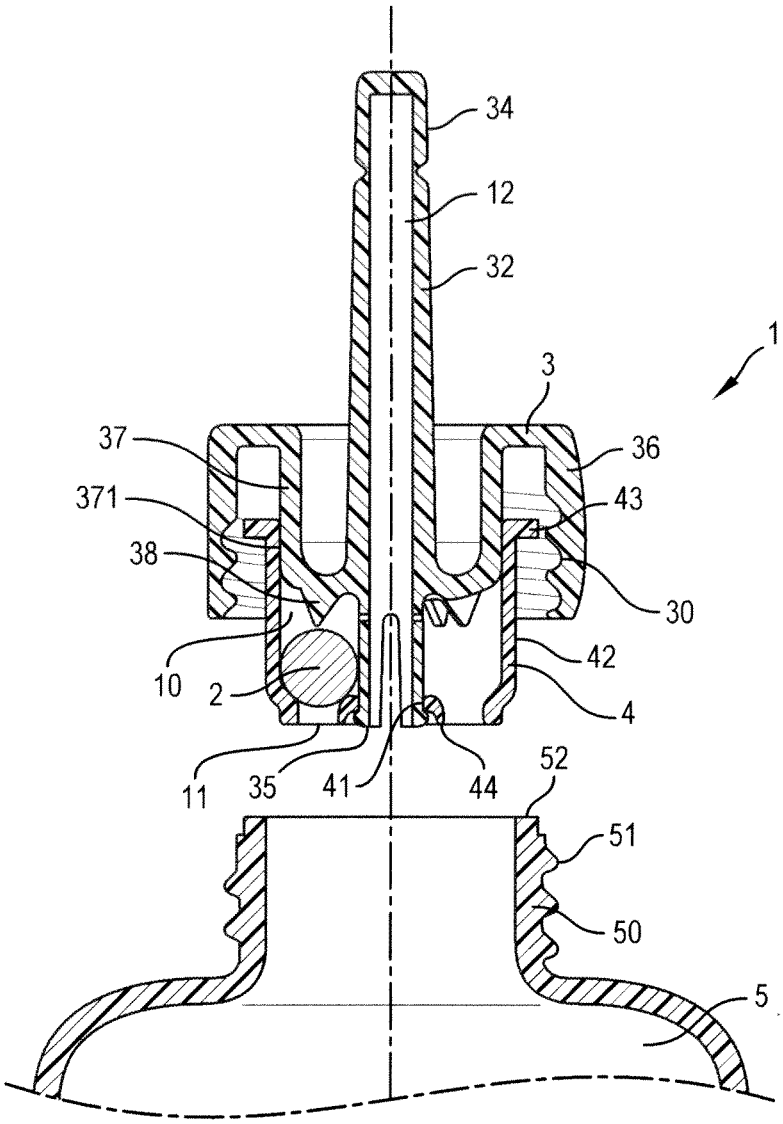

FIG. 7 is a sectional view along line J-J of FIG. 6.

The device is composed as a stopper 1, made of two pieces: a cap 3 and an insert 4. A capsule 2 is situated between these two pieces. Although only one spherical capsule is represented in these figures, it is understood that the device can comprise several capsules, optionally containing different products to be released, and having different shapes and dimensions as the case may be.

The stopper 1 is fitted by screwing it on the neck 50 of a container 5 which contains a base product intended to be mixed with the product to be released contained in the capsule 2.

Through the stopper 1 passes a hollow dispensing tube 12 which emerges in the container 5.

The cap 3 is in the form of a nozzle comprising a central end 32 through which passes said hollow dispensing tube 12.

The end of the hollow dispensing tube 12 opposite the container 5 is sealed by a protective cap 34, which is connected to end 32, for example, by a zone that is less thick and that can be broken by hand.

The insert 4 has a general U shape with a more or less cylindrical peripheral wail 42 and a bottom 44 with openings 11 for releasing the product contained in the capsule and a central opening 41 provided for the distribution of the mixture obtained, through the hollow dispensing tube 12. The bottom 44 of the insert 4 forms the second movable component in the context of the invention.

In addition to the central end 32, the cap 3 has two more or less cylindrical coaxial peripheral walls 36 and 37.

The outer wall 36 has, on its inner side, a screw thread 30 adapted to the screw thread 51 of the neck 50.

The intermediate wall 37 has an outer diameter slightly smaller than the inner diameter of the peripheral wall 42 of the insert 4, allowing the insert 4 to slide relative to the cap 3.

In the cap 3, the wall connecting the intermediate wall 37 and the central end 32 has one or more teeth 38 located opposite the openings 11 of the insert 4 provided for the release of the product contained in the capsule 2. This tooth-covered wall 38 forms the first movable component in the context of the invention.

Before the device is used, the cap 3 and the insert 4 are maintained with a gap between each other by virtue of a peripheral gadroon 371 on the insert 4 which is positioned in a housing provided for this purpose in the wall 37 of the cap 3, in order to preserve the integrity of the capsule 2.

This means of restrain is able to yield under the effect of a suitable force exerted by the user, so as to bring together the insert and the cap in view of releasing the product contained in the capsule.

In the example illustrated here, the end of end 32 located on the side of the container has, on its outer wall, a peripheral collar 35 of a diameter slightly larger than that of the opening 41 of the insert 4.

Thus, a rigid chamber 10 for the capsule 2 is formed.

Advantageously, the openings 11 located on the bottom 44 of the insert 4 are circular and have a flared profile making it possible to maintain the capsule 2 beneath the corresponding tooth 38. The bottom 44 of the insert 4 forms the second movable component in the context of the invention.

Figure 8:
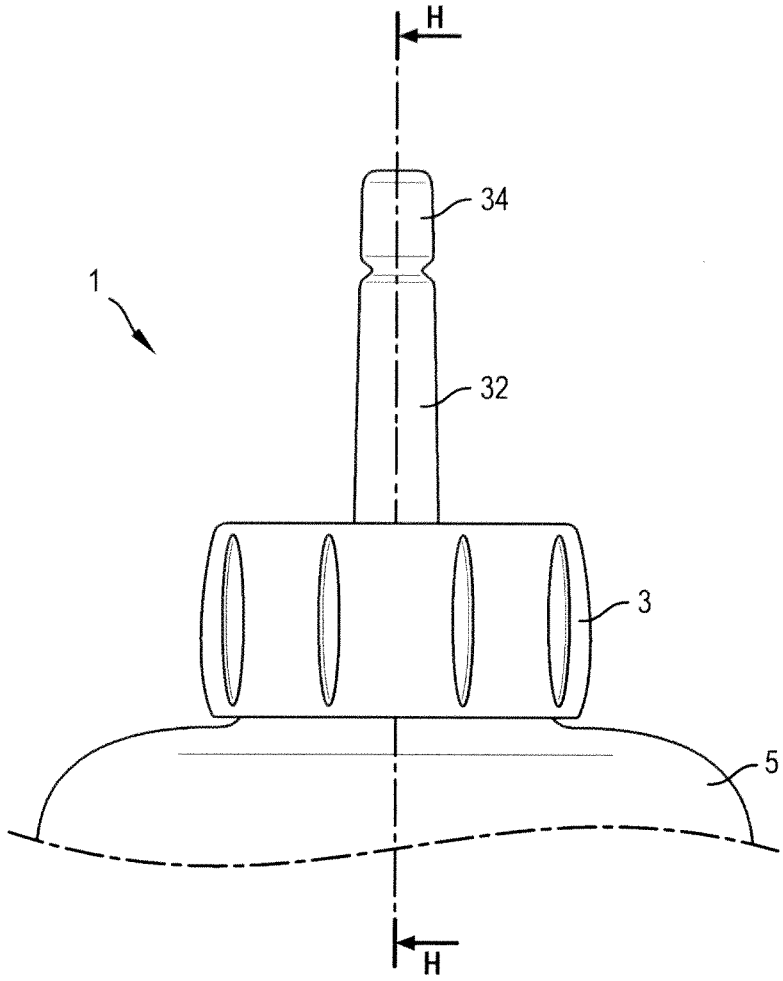

FIG. 8 is a side view of the packaging configured for use.

Figure 9:
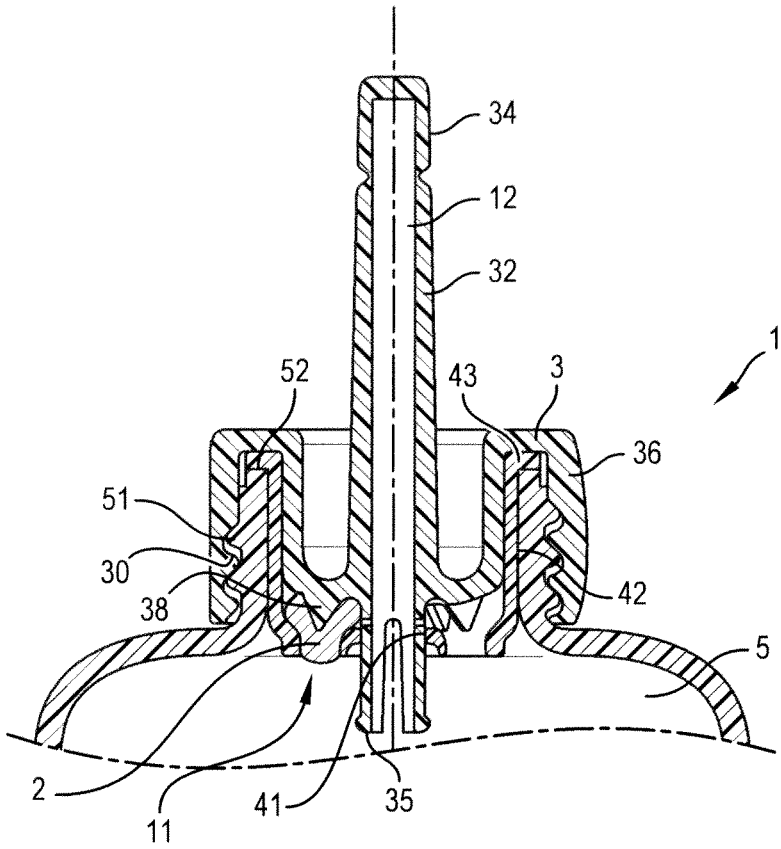

FIG. 9 is a sectional view along line H-H of FIG. 8.

In view of the release of the product contained in capsule 2, the user screws the stopper 1 on the neck of the container 5; the collar 43 located on the outside of the cylindrical wall 42 stops against the upper edge 52 of the neck. Continued screwing then causes the cap 3 and the insert 4 to be brought together. The tooth 38 ruptures the wall of the capsule 2, whose contents are released in the container 5 through the opening 11.

Thus, a single screwing movement of the stopper on the neck releases the contents of the capsule.

This design has the advantage that the rupturing of the capsules is dependent only on the force of the screw thread and not the force of the user, thus providing a repeatable result regardless of the user.

This also makes it possible to use capsules with a higher resistance than those of the prior art, which facilitates the packaging and the transport of the capsules before their insertion in the device.

After having proceeded to the mixing of the released product and the base product, the user breaks the protective cap 34 and distributes the mixture through the hollow dispensing tube 12.

The variant of execution just described is particularly suitable for the extemporaneous mixing of a fragrance composition with a cosmetic base product, such as a hair coloring, with a view to masking the odor of ammonia.

However, it is well understood that this example is in no way restrictive and that the capsule or capsules can contain any active agent mentioned above.

The invention claimed is:

1. A removable device for preserving and releasing a product contained in a reservoir having a rupturable wall for releasing said product, wherein said device comprises a rigid chamber of variable volume containing at least one reservoir containing said product, wherein said chamber comprises at least one opening for releasing the product and comprising two components that can be moved with respect to each other, delimiting the chamber of variable volume in order to cause the rupturing of the rupturable wall by crushing when they are brought together, wherein said device is in the form of a stopper intended to be fitted on a container, and comprising:

a cap which is able to engage with a neck of said container and through which passes a hollow dispensing tube which leads into said container, wherein said cap comprises the first movable component, an insert able to be positioned on or in the neck of said container, wherein said insert comprises the second movable component, wherein said cap and said insert delimit said rigid chamber of variable volume, and can be moved with respect to each other in order to cause the rupturing of the rupturable wall by crushing when they are brought together, wherein said stopper comprises the means to displace the cap with respect to the insert and with respect to the neck, consisting of a screw thread engaging with a screw thread interdependent of with the neck.

2. The device of claim 1, further comprising the means of restrain for maintaining the two movable components in a given "distant" position, said means being able to yield when a suitable force is applied to the device to enable the bringing together of said movable components.

3. The device of claim 1, wherein the insert consists of a cylindrical peripheral wall extending from a bottom, wherein the upper end of the peripheral wall comprises a collar resting on the upper edge of the neck of the container, and wherein the bottom of the insert comprises the opening or openings for the distribution of the product in the container.

4. The device of the claim 3, wherein the bottom of the insert further has a central opening for the distribution of the mixture obtained, through the hollow dispensing tube.

5. The device of claim 1, wherein the bottom of the insert forms said second movable component.

6. The device of claim 1, wherein said cap has a bottom with an outer side forming said first movable component.

7. The device of claim 1, wherein the cap has one or more teeth located opposite the openings of the insert.

8. The device of claim 1, wherein the opening or openings are proportioned to maintain the reservoir or reservoirs in the chamber before and after the rupturing of the rupturable wall.

9. The device of claim 1, wherein the reservoir is a spherical capsule having a rupturable wall.

10. The device of claim 9, wherein the openings are circular and of a smaller diameter than that of the capsules.

11. The device of claim 1, comprising as many openings as reservoirs.

12. A packaging for the preserving of two products intended to be mixed extemporaneously before their distribution, comprising a container comprising a base product and a stopper comprising a product to be released, wherein the stopper is the device of claim 1.

13. A method for distributing a mixture of products prepared extemporaneously before their distribution, wherein said process comprises:

the application on the stopper of the packaging according to claim 12 of a suitable force to bring the movable components closer together in order to enable the rupturing of the rupturable wall of the reservoir and the releasing of the product in the container comprising the base product, the mixing of the released product with the base product, and then the distribution of the mixture obtained out of the container.

14. The method of claim 13, wherein the base product is selected from: a pharmaceutical composition, a drug, a cosmetic composition for the skin or hair, foodstuffs, processed foodstuffs, nutraceuticals or health foods, a product of personal, domestic or industrial hygiene, a phytopharmaceutical product or an insecticide.

* * * * *

UNITED STATES PATENT AND TRADEMARK OFFICE

CERTIFICATE OF CORRECTION

PATENT NO. : 8,584,839 B2
APPLICATION NO. : 13/128872
DATED : November 19, 2013
INVENTOR(S) : Louis Aguadisch, Gilles Stalet and Patrick Sivera It is certified that error appears in the above-identified patent and that said Letters Patent is hereby corrected as shown below:

On the Title Page 2, in Item [56], under Other Publications, at line 1, please delete "nte ational" and insert --International--.

Signed and Sealed this
Twenty-second Day of July, 2014

Michelle K. Lee

Michelle K. Lee
*Deputy Director of the United States Patent and Trademark Office*